US010480268B2

(12) United States Patent
Parker et al.

(10) Patent No.: US 10,480,268 B2
(45) Date of Patent: Nov. 19, 2019

(54) METHOD FOR SEALING AN OPENING OF A WELLBORE EQUIPMENT

(71) Applicant: Blue Spark Energy Inc., Calgary (CA)

(72) Inventors: Todd Parker, Calgary (CA); Shawn Carroll, Calgary (CA)

(73) Assignee: Blue Spark Energy Inc., Calgary (CA)

( * ) Notice: Subject to any disclaimer, the term of this patent is extended or adjusted under 35 U.S.C. 154(b) by 177 days.

(21) Appl. No.: 15/164,544

(22) Filed: May 25, 2016

(65) Prior Publication Data

US 2016/0348475 A1 Dec. 1, 2016

Related U.S. Application Data

(60) Provisional application No. 62/166,552, filed on May 26, 2015.

(51) Int. Cl.
*E21B 29/10* (2006.01)

(52) U.S. Cl.
CPC ..... *E21B 29/10* (2013.01)

(58) Field of Classification Search
CPC ..... E21B 34/102; E21B 29/10; E21B 43/10
See application file for complete search history.

(56) References Cited

U.S. PATENT DOCUMENTS 2,214,226 A * 9/1940 English ..... E21B 29/10 138/93
3,167,122 A 1/1965 Lang
3,180,418 A 4/1965 MacLeod
4,343,356 A * 8/1982 Riggs ..... E21B 36/04 166/248
4,345,650 A * 8/1982 Wesley ..... E21B 36/04 166/177.2
5,004,050 A 4/1991 Sizonenko et al.
5,573,307 A * 11/1996 Wilkinson ..... E21B 7/15 166/299
2007/0175634 A1* 8/2007 Wardlaw ..... E21B 29/02 166/277
2010/0071898 A1* 3/2010 Corre ..... E21B 33/12 166/264
2014/0008073 A1* 1/2014 Rey-Bethbeder ..... E21B 36/04 166/308.1

OTHER PUBLICATIONS

FKM Rubber Property Sheet https://www.robinsonrubber.com/pdfs/FKMRubber.pdf (Year: 2005).*
Extended European Search Report from the European Patent Office on corresponding EP application (EP 15169136.7) dated Jul. 14, 2015.

* cited by examiner

*Primary Examiner* — David Carroll
(74) *Attorney, Agent, or Firm* — Klein, O'Neill & Singh, LLP

(57) ABSTRACT

Aspects of the present disclosure include a system and a method for sealing at least one opening of a wellbore equipment arranged in a wellbore of a subterranean formation in order to improve the recovery of formation fluids and/or gases. The method includes the steps of positioning a metal patch between the wellbore equipment and a shock wave generation device. The metal patch faces the at least one opening to be sealed and the method further including generating, using a shock wave generation device, at least one electrical discharge into said wellbore in order to propagate toward said metal patch at least one shock wave adapted to deform and fix the metal patch onto the wellbore equipment, sealing therefore the at least one opening.

18 Claims, 9 Drawing Sheets

METHOD FOR SEALING AN OPENING OF A WELLBORE EQUIPMENT

FIELD OF ART

The field of the invention relates to the sealing of openings, such as perforations, holes, cracks or the like and, more particularly, to a method and device for sealing an opening of an equipment arranged in a wellbore of a subterranean formation in order to improve the recovery of formation fluids and/or gases. A preferred application of the invention concerns sealing at least one perforation of a metallic casing arranged in a wellbore.

BACKGROUND

In the art of well boring, a borehole is drilled into the earth through the oil or gas producing subterranean formation or, for some purposes, through a water bearing formation or a formation into which water or gas or other liquids are to be injected.

Completion of a well may be carried out in a number of ways dependent upon the nature of the formation of interest. In particular, it is known to arrange a casing into the wellbore to control formation elements. Once installed into the wellbore, the casing is then perforated in a plurality of areas for allowing the passage of oil and/or gas from the formation into the casing.

When the casing suffers damage, corrosion or leaks, metal patches may be used to repair the casing and enable production to be improved. Similarly, in depleted wells nearing the end of viable production, a metal patch may be used to seal some of the perforations of the casing to improve the recovery of oil and/or gas. In some cases, such sealing may be the only economic means of safely returning the well to production.

Two main techniques are known to apply a metal patch on a casing arranged in a wellbore: mechanical expansion and hydraulic pressure. An example of mechanical expansion is described in U.S. Pat. No. 6,668,930 and consists in arranging a coiled tubing into the casing then using a tool for pressing the coiled tubing against an area of the casing in order to create a patch on said area. An example of solution using hydraulic pressure is described in U.S. Pat. No. 6,775,894 and consists in loading a coiled tubing into a delivery tool comprising a plunger then applying hydraulic pressure for pushing the plunger against the coiled tubing in order to release the coiled tubing into the casing and therefore sealing the openings of the casing in the corresponding area. The utilization of such mechanical or hydraulic pressure tools is complex, time-consuming and costly. Moreover, such methods of sealing openings may be unreliable as the pressure may not be sufficient to solidly fix the patch and properly seal the openings.

It is therefore an object of the present invention to provide an improved method and system for efficiently, rapidly, easily and effectively sealing an opening of a equipment arranged in a wellbore of a subterranean formation in order to improve the recovery of formation fluids and/or gases. Another and further object of the present invention is to provide an improved method and system for sealing a tube arranged in a wellbore. Another and further object of the present invention is to provide an improved method and device for sealing a perforation of a metallic casing arranged in a wellbore.

SUMMARY

To this end, the present invention concerns a method for sealing at least one opening of a wellbore equipment arranged in a wellbore of a subterranean formation in order to improve the recovery of formation fluids and/or gases, said method comprising the steps of:

- positioning a metal patch between said wellbore equipment and a shock wave generation device, said metal patch facing the at least one opening to be sealed;
- generating, using a shock wave generation device, at least one electrical discharge into said wellbore in order to propagate toward said metal patch at least one shock wave adapted to deform and fix the metal patch onto the wellbore equipment, sealing therefore the opening.

The method according to the invention allows thus efficiently, easily and rapidly for sealing an opening of a wellbore equipment arranged in a wellbore. Such opening may be a perforation, a hole, a crack or the like. The wellbore equipment may be a metallic casing. Thus, for example, the method may be advantageously used to seal perforations, previously made in a metallic casing disposed in a wellbore for recovering oil or gas for a subterranean formation, allowing therefore stimulation the recovery.

The method according to the invention provides an electrohydraulic forming (EHF) process for solidly fixing the metal patch to the wellbore equipment as the metal constituting the patch penetrates into the opening, allowing strongly fixing the metal patch to the wellbore equipment. In other words, electrohydraulic forming allows pushing the material constituting the metal patch enough into the opening to fix the metal patch solidly onto the wellbore equipment and improve significantly the recovery of oil and/or gas.

The metal patch may take any adapted shape such as; e.g., a tube or a plate such as a curved plate. A plate may be used to seal a unique perforation. A tube may be used to seal a plurality of perforations at the same time.

In an embodiment according to the invention, a series of at least ten shock waves, preferably twenty shock wave, is generated for efficiently fixing the patch to the wellbore equipment.

In a preferred embodiment, a plurality of series of shock waves is generated. Advantageously, each series of shock waves is generated repeatedly at different locations along the wellbore equipment, for example different heights of a casing. Preferably, the different locations correspond to different locations of openings. Using a plurality of series of shock waves allows advantageously fixing solidly the patch to the wellbore equipment.

Preferably, the at least one shock wave propagates radially. For example, when the metal patch is shaped as a tube, this allows sealing simultaneously a plurality of openings.

In another embodiment, the at least one shock wave propagates in a predetermined direction toward the metal patch, for example using a reflector. In this case, the metallic patch may be a curved plate which is positioned in front of a unique perforation and the at least one shock wave is propagated in a predetermined direction toward said curved plate.

In a preferred embodiment, the at least one shock wave is generated in a transmitting fluid, such as e.g. water or oil.

In an embodiment, the at least one shock wave is generated in a transmitting liquid. Preferably, the transmitting liquid is at least partially delimited by a membrane and the at least one shock wave is propagated through said membrane toward the metal patch for sealing the at least one opening.

The invention also concerns a shock wave generation device for sealing with a metal patch at least one opening of a wellbore equipment arranged in a wellbore of a subterranean formation in order to improve the recovery of formation fluids and/or gases, said shock wave generation device comprising a discharge unit configured for generating at least one electrical discharge that propagates at least one shock wave toward said metal patch at least one shock wave adapted to deform and fix the metal patch onto the wellbore equipment, sealing therefore the at least one opening.

The shock wave generation device is a source of electrohydraulic energy, which allows the metal patch to be solidly fixed on the wellbore equipment to seal the at least one opening by electrohydraulic forming (EHF).

Preferably, the discharge unit comprises a first electrode and a second electrode for generating a high voltage arc, preferentially in a shock wave transmitting liquid.

In an embodiment, the discharge unit is configured for generating at least one electrical discharge that propagates at least one shock wave radially.

In another embodiment, the discharge unit is configured for generating at least one electrical discharge that propagates at least one shock wave in a predetermined direction.

According to an embodiment, the shock wave generation device comprises a chamber which is at least partially filled with a shock wave transmitting liquid and a membrane delimiting at least partially said chamber. In particular, such membrane isolates the liquid in the chamber from elements of the wellbore surrounding the shock wave generating device, such as e.g. mud or other fluids, while maintaining acoustic coupling with the control equipment, improving thus the propagation of shockwaves while preventing external fluids from damaging the discharge unit. Such flexible membrane prevents in particular the deposits and other elements from damaging electrodes and other components (insulators) of the discharge unit.

Preferably, the membrane is deformable and/or flexible and/or elastic in order to prevent the at least one shock wave to bounce on it and to conduct efficiently the at least one shock wave toward the metal patch.

In an embodiment according to the invention, the membrane is made of fluorinated rubber or other fluoro elastomer.

In an embodiment according to the invention, the relative elongation of the membrane is at least 150%, preferably at least 200% in order to be used efficiently in oils, fuels, liquid reservoirs, aliphatic or aromatic hydrocarbons etc.

In an embodiment according to the invention, the membrane is operable between −35° C. and 250° C. in order to be used in oils, fuels, liquid reservoirs, aliphatic and/or aromatic hydrocarbons etc.

In another embodiment, the shock wave generation device comprises at least one metallic wire mounted between the first electrode and the second electrode for creating a pressure wave. When a current circulates between the first electrode and the second electrode, the at least one metallic wire heats until vaporization, generating therefore a pressure wave that propagates into the fluid.

In a preferred embodiment according to the invention, the shock wave generation device further comprises a power conversion unit, a power storage unit and a control unit.

The invention also concerns the use of a shock wave generation device as previously described for sealing with a metal patch at least one opening of a wellbore equipment arranged in a wellbore of a subterranean formation in order to improve the recovery of formation fluids and/or gases.

The invention also concerns a system comprising a shock wave generation device as previously described, a wellbore equipment comprising at least one opening to be sealed, e.g. such as a casing, arranged in a wellbore of a subterranean formation and at least one metal patch arranged in said wellbore, between said shock wave generation device and said wellbore equipment, and facing said at least one opening to be sealed.

In an embodiment according to the invention, the system further comprises a connection mean coupled to the shock wave generation device for inserting said shock wave generation device in the wellbore nearby the wellbore equipment, a voltage source located external of the wellbore and an electrical circuit within said wireline for connecting said voltage source to the shock wave generation device.

For example, the connection mean may be a wireline for a vertical wellbore, a wireline tractor for pushing the device into both vertical or horizontal wellbores or a coiled tubing for both vertical or horizontal wellbores. In the case of a coiled tubing, the device is mounted on the coiled tubing which is then introduced into the wellbore.

The invention also concerns a wellbore for recovering formation fluids or gases from a subterranean formation, said wellbore comprising at least one wellbore equipment arranged into said wellbore and comprising at least one opening to be sealed, a shock wave generation device as previously described and at least one metal patch arranged in the wellbore between said shock wave generation device and said wellbore equipment, facing said at least one opening.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

Figure 1:
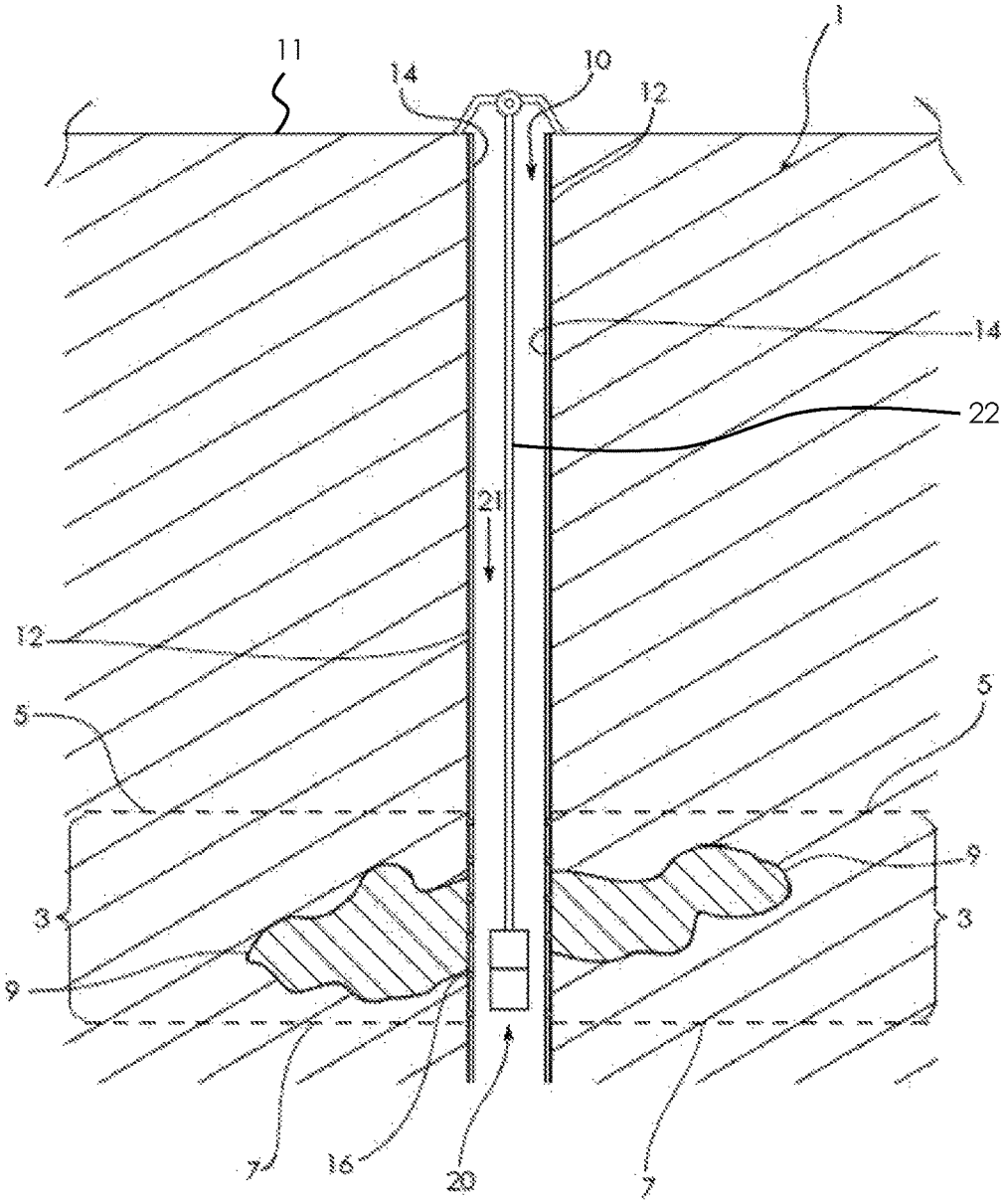
FIG. 1 schematically illustrates a cross-sectional view of a wellbore comprising a casing and a shock wave generation device.
Figure 2:
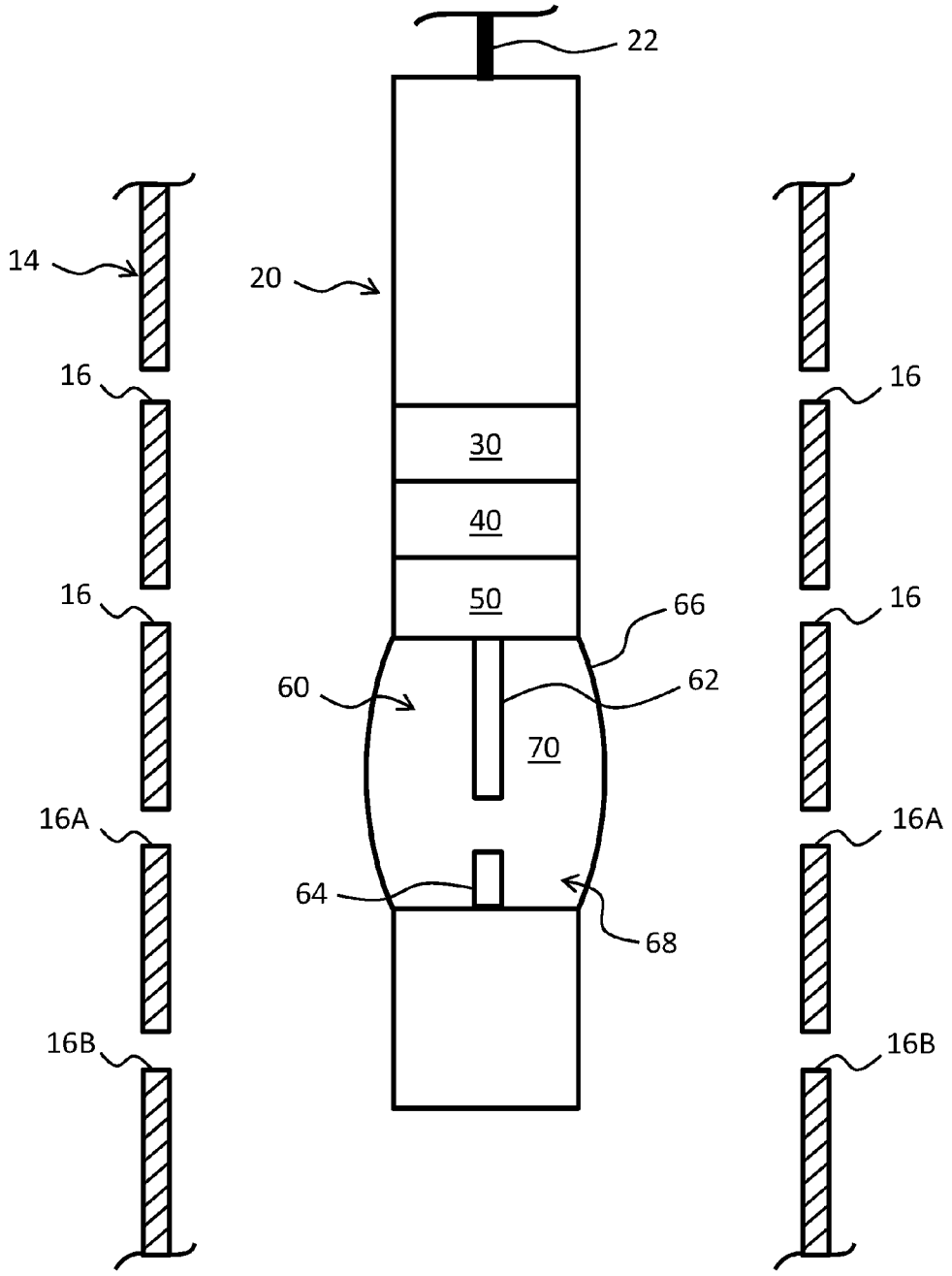
FIG. 2 schematically illustrates a cross-sectional view of an embodiment of a shock wave generation device according to the invention positioned into the casing of the wellbore of FIG. 1 and facing a first plurality of perforations.

In the accompanying Figures, similar components or features, or both, may have the same or a similar reference label.

DETAILED DESCRIPTION

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification.

Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use.

Spatial terms describe the relative position of an object or a group of objects relative to another object or group of objects. The spatial relationships apply along vertical and horizontal axes. Orientation and relational words including "uphole" and "downhole"; "above" and "below"; "up" and "down" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided.

Where the Specification and appended Claims reference a method comprising two or more defined steps, the defined steps can be carried out in any order or simultaneously except where the context excludes that possibility.

The invention is described hereunder in reference to a well for producing formation fluids or gases such as e.g. oil wherein the formation is a sand formation. This does not limit the scope of the present invention which may be used with any type of formation wherein formation elements arranged on or between control particles of a formation control apparatus could prevent the passage of formation fluids or gases.

FIG. 1 shows a subterranean formation 1 comprising a treatment zone 3. For example, such a treatment zone 3 may be made of rock. In this example, treatment zone 3 has an upper bound 5 and a bottom bound 7. The treatment zone 3 comprises a porous zone 9 that constitutes a reservoir of hydrocarbons, such as oil or gas.

The porous zone 9 is accessible through a wellbore 10 extending from the surface 11 through to the treatment zone 3. The uphole bound 5 is the uphole-most portion of treatment zone 3 accessible through wellbore 10 and the downhole bound 7 is the downhole-most portion of treatment zone 3 accessible through wellbore 10.

The treatment zone 3 interfaces with the wellbore 10 at wellbore wall 12 and extends radially from wellbore 10. In this example, the wellbore 10 is vertical, but this does not limit the scope of the present invention as the method and device according to the invention may advantageously be used in any type of wellbores such as e.g. horizontal wellbores.

In the example illustrated on FIG. 1, this wall 12 comprises a wellbore equipment which is a metallic casing 14. This metallic casing 14 comprises perforations 16 that allow creating some flow paths within the treatment zone 3 adjacent to the wellbore 10. Such metallic casing 14 is known from the person skilled in the art.

A source of electrohydraulic energy in the form of a shock wave generation device 20 is introduced (arrow 21) into the wellbore 10 and positioned near the wellbore wall 12. The shock wave generation device 20 is configured for generating a series of electrical discharges that propagate a series of shock waves.

FIGS. 2 to 8 illustrates a preferred embodiment of the shock wave generation device 20 according to the invention. The shock wave generation device 20 is coupled to a wireline 22 which is operable to raise and lower said shock wave generation device 20 and to supply power from the surface 11 (in reference to FIG. 1) to said shock wave generation device 20. A voltage source (not shown) located external of the wellbore 10 and an electrical circuit (not shown) mounted within said wireline 22 allow connecting said voltage source to the shock wave generation device 20. Electrical power is supplied by the low voltage source at a steady and relatively low power from the surface 11 through the wireline 22 to the downhole shock wave generation device 20.

In this example, and as already describes in U.S. Pat. No. 4,345,650 issued to Wesley or U.S. Pat. No. 6,227,293 issued to Huffman, incorporated hereby by reference, the shock wave generation device 20 comprises a power conversion unit 30, a power storage unit 40, a control unit 50 and a discharge unit 60.

The power conversion unit 30 comprises suitable circuitry for charging of the capacitors in the power storage unit 40. Timing of the discharge of the energy in the power from the power storage unit 50 through the discharge unit 60 is controlled by the control unit 50.

In a preferred embodiment, the control unit 50 is a switch, which discharges when the voltage reaches a predefined threshold.

The discharge unit 60 comprises a first electrode 62 and a second electrode 64 configured for triggering an electrical discharge. The discharge unit 60 may be configured to propagate shock waves radially or in a predetermined direction. Upon discharge of the capacitors in the power storage section through the first electrodes 62 and the second electrode 64, electrohydraulic shock waves 60 (in reference to FIGS. 4 and 7) are generated.

The discharge unit 60 comprises a plurality of capacitors (not represented) for storage of electrical energy configured for generating one or a plurality of electrical discharges. Other designs of discharge unit 60 are disclosed in U.S. Pat.

No. 6,227,293 issued to Huffman which is included hereby reference. According to the electrohydraulic effect, an electrical discharge is discharged in a very short time (few micro seconds).

In this example, the discharge unit 60 further comprises a membrane 66 delimiting a chamber 68 which is filled with a shock wave transmitting liquid 70, allowing transmitting shock waves through the membrane 66 toward the metallic casing 14. In another embodiment, the discharge unit 60 may not comprise a membrane 66. Such membrane 66 isolates the discharge unit 60 from the wellbore 20 while maintaining acoustic coupling with said wellbore 20, improving the propagation of shockwaves while preventing external fluids from the wellbore 20 from damaging the discharge unit 60.

In a preferred embodiment, the membrane 60 is flexible in order to an efficient propagation of shock waves in many directions and prevent shock waves to bounce on it, allowing therefore an efficient conduction of the shock wave toward a metal patch to be sealed on the metallic casing 14. To this end, the membrane 40 may be made of fluorine rubber or fluoro elastomer with a relative elongation of at least 150%, preferably at least 200% and being operable between −35° C. and 250° C.

In reference to FIGS. 3 to 8, the system according to the invention comprises a metal patch 80. In this embodiment, the patch 80 is shaped like a tube. Of course, this does not limit the scope of the present invention as the metal patch could be shaped as a plate or any other suitable form. The thickness of the metal patch 80 may range, for example, from 2 to 6 mm. The height and width of the metal patch 80 may range, e.g. from 10 cm to 1 meter of more.

Examples of Operation

The invention is describes in its application to sealing perforations made in a metallic casing 14. As described on FIG. 2, the shock wave generation device 20 is first positioned, in step S1, inside the casing 14 in front of a first plurality of perforations 16A to be sealed. An optimized position of the shock wave generation device 20 is defined by the alignment of the perforations 16A with the space between the first electrode 62 and the second electrode 64, as shown on FIG. 2.

Figure 3:
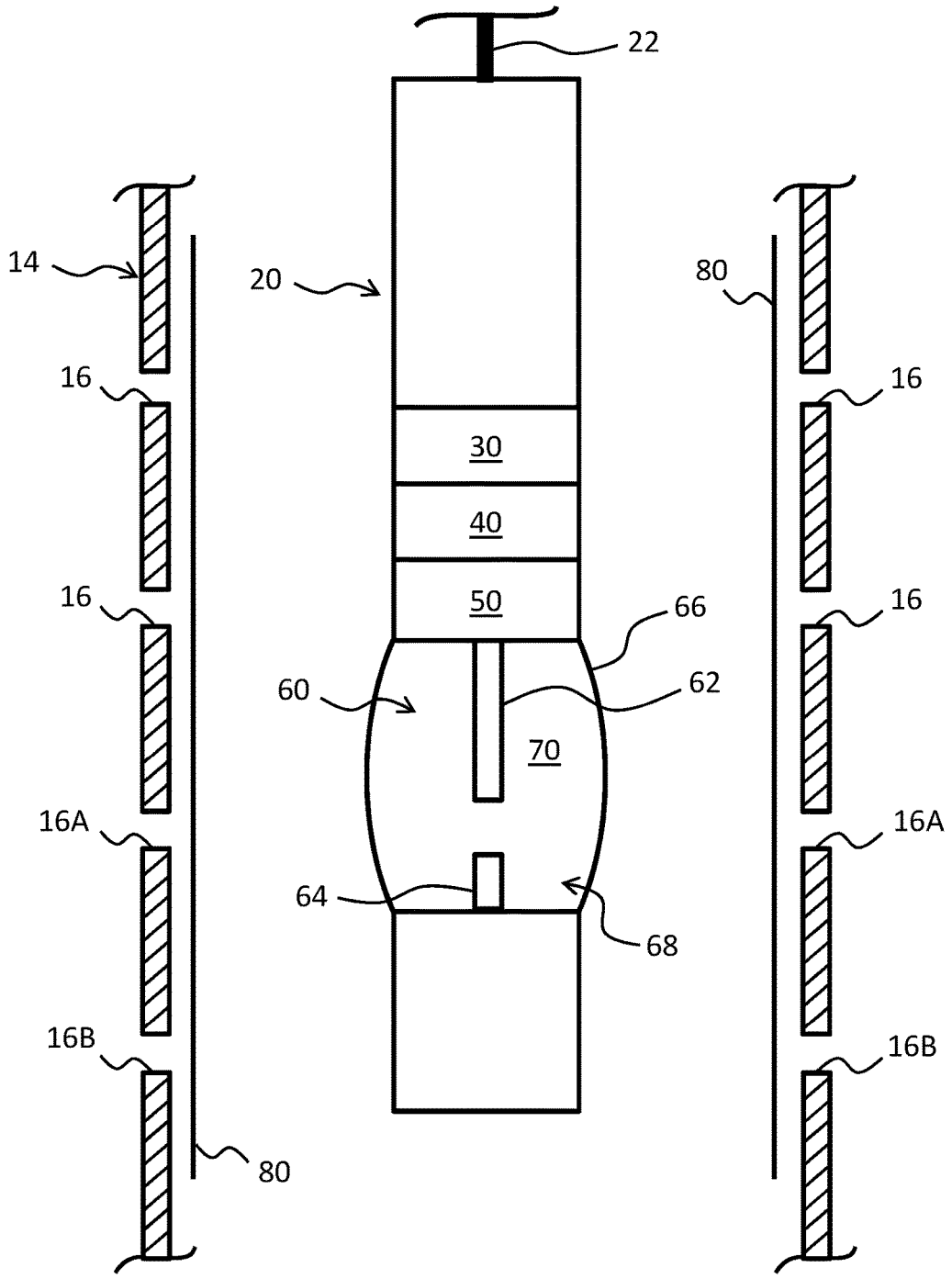
FIG. 3 illustrates the wellbore of FIG. 2 further comprising a metal patch.
Figure 4:
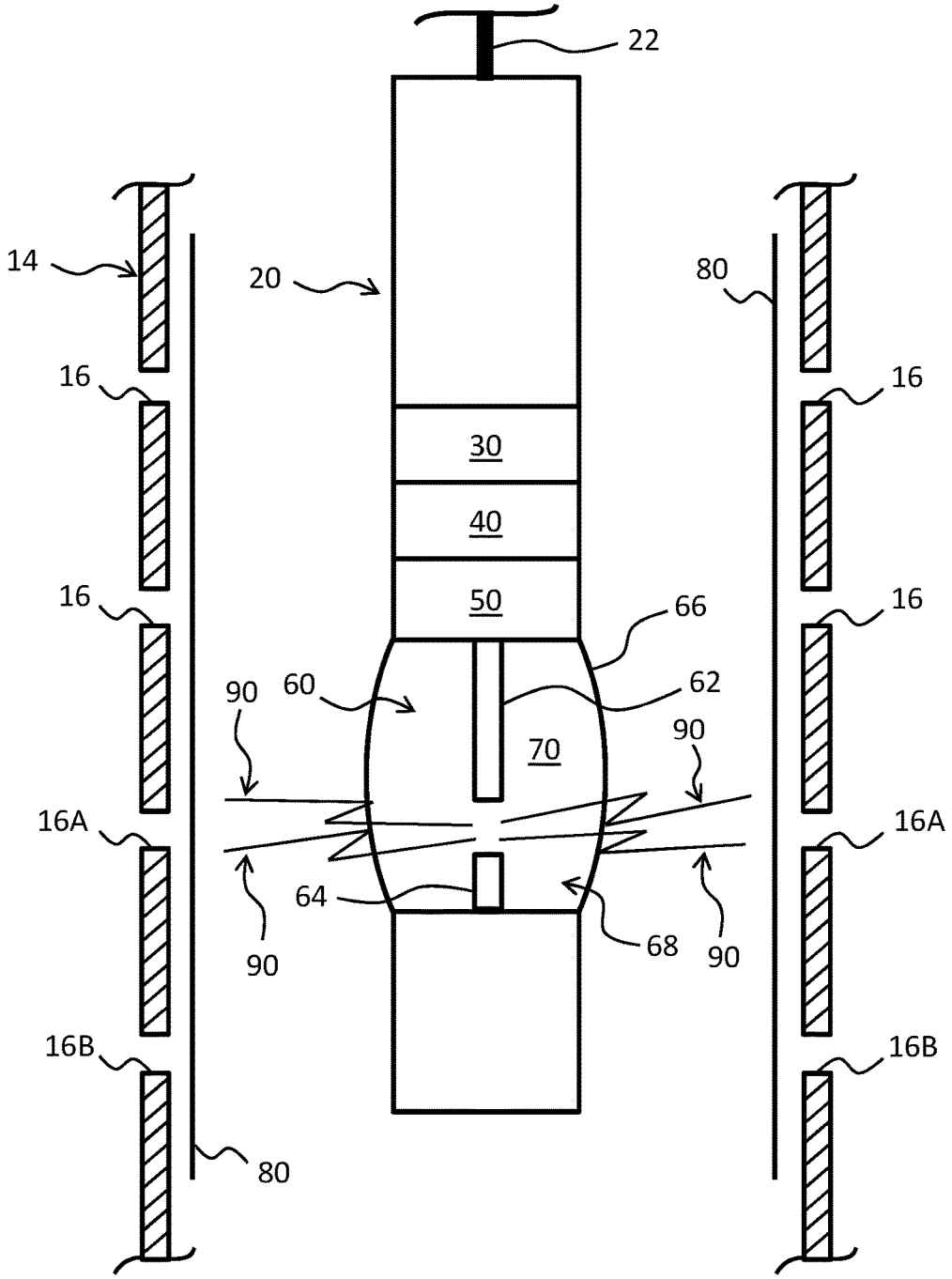
FIG. 4 illustrates shockwave generation by the shock wave generation device of FIGS. 2 and 3.

Then, in step S2, as described on FIG. 3, the metal patch 80 is positioned inside the wellbore 10 between the shock wave generation device 20 and the first plurality of perforations 16A to be sealed. Of course, steps S1 and S2 may be inverted as the metal patch 80 may be positioned in the wellbore 10 before the shock wave generation device 20.

In step S3, at least one shock wave 90, preferably a series of shock waves, is generated into the transmitting liquid 70 by the discharge unit 60 of the shock wave generation device 20. This at least one shock wave 90 propagates in step S4 through the membrane 40 toward the metal patch as illustrated on FIG. 4.

Figure 5:
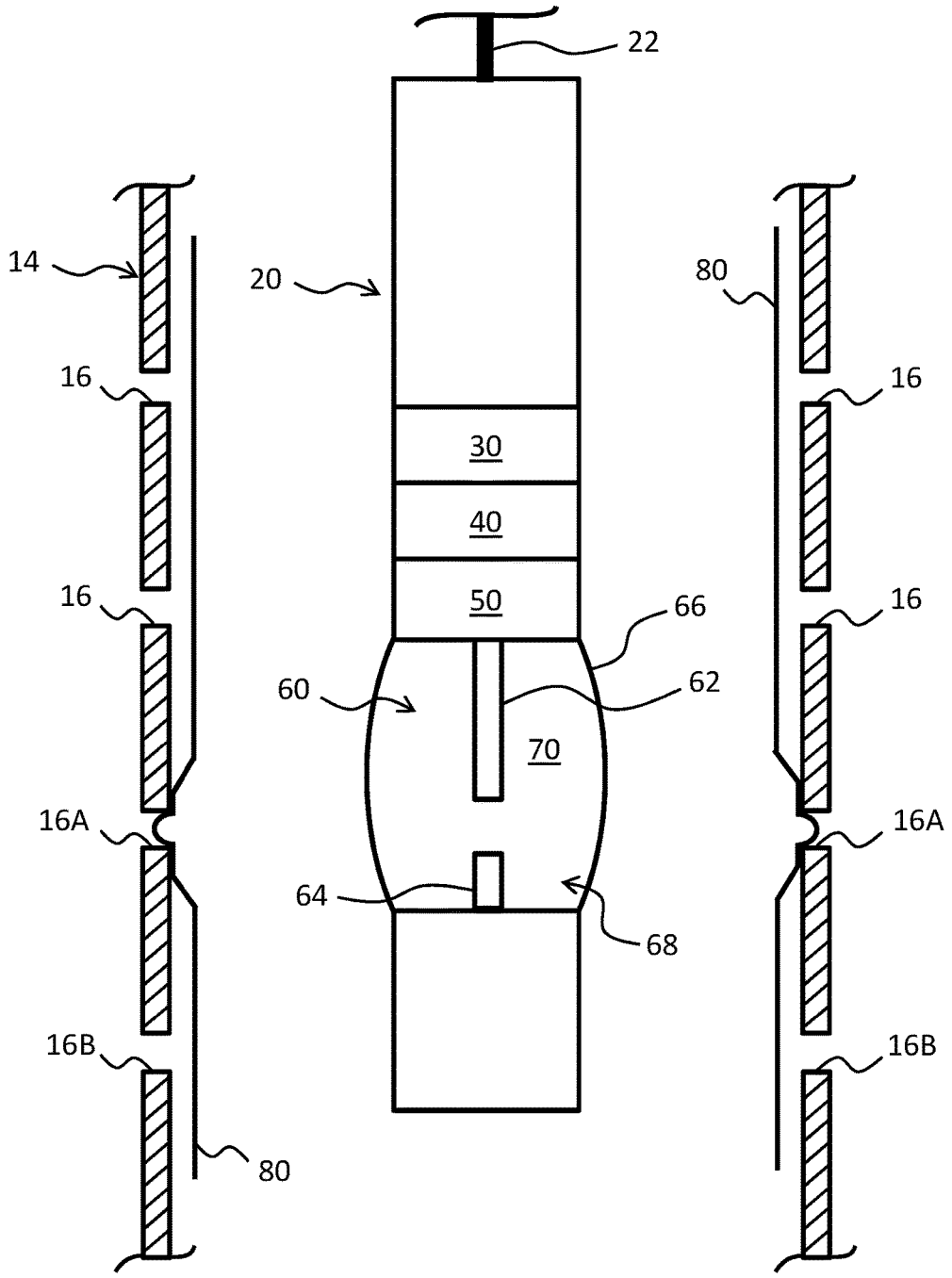
FIG. 5 illustrates sealed casing perforations following shockwave generation by the shock wave generation device of FIGS. 2 to 4.

In step S5, the at least one propagated shock wave 90 deforms the metal patch 80 in an electrohydraulic forming process so that said metal patch 80 is compressed against the casing 14 on and into perforations 16A of the first plurality of perforations 16A, fixing the metal patch 80 to the casing 14 and sealing eventually therefore said perforations 16A as illustrated on FIG. 5.

Figure 6:
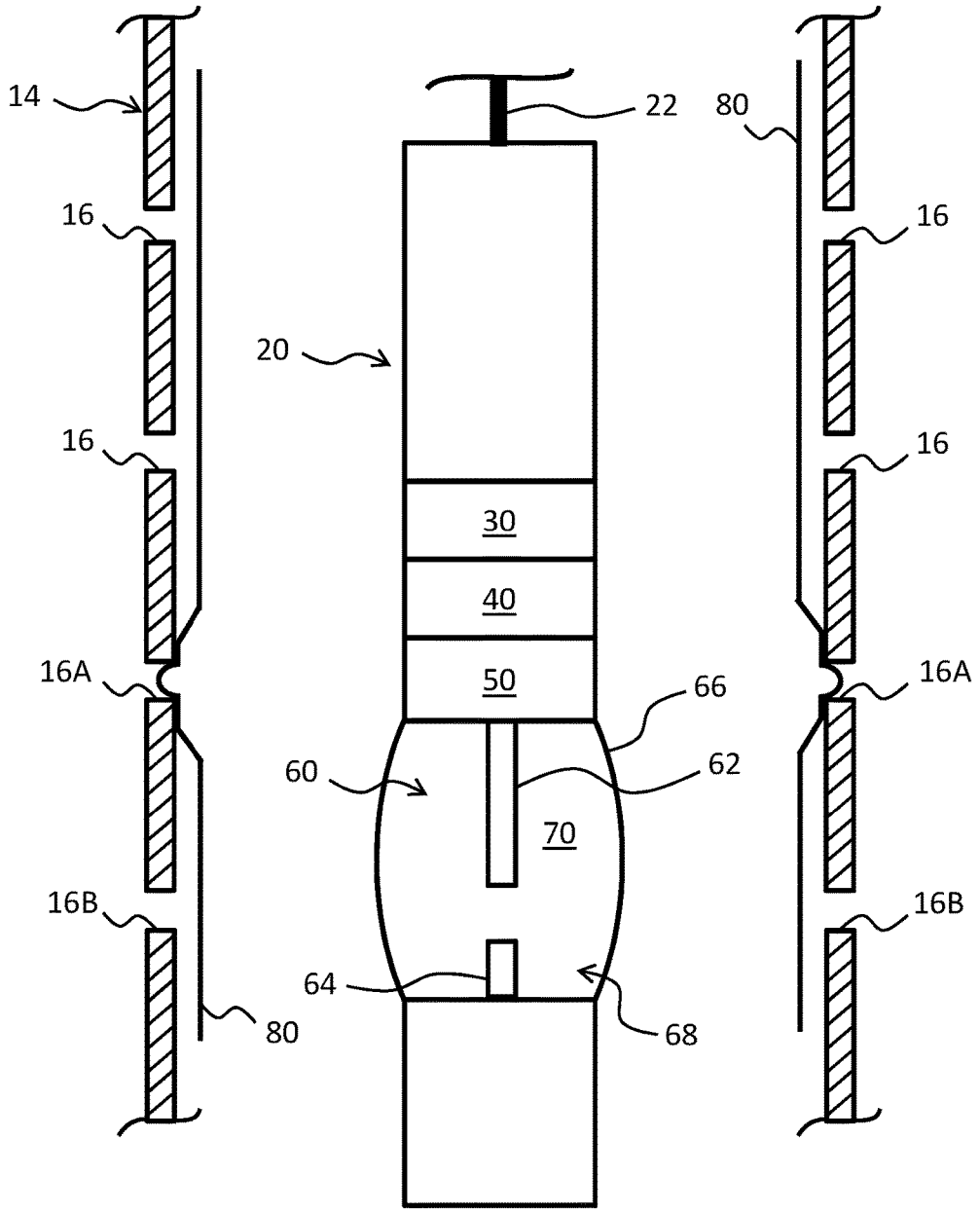
FIG. 6 illustrates the shock wave generation device of FIGS. 2 to 5 positioned at a different height in the wellbore, facing a second plurality of perforations.
Figure 7:
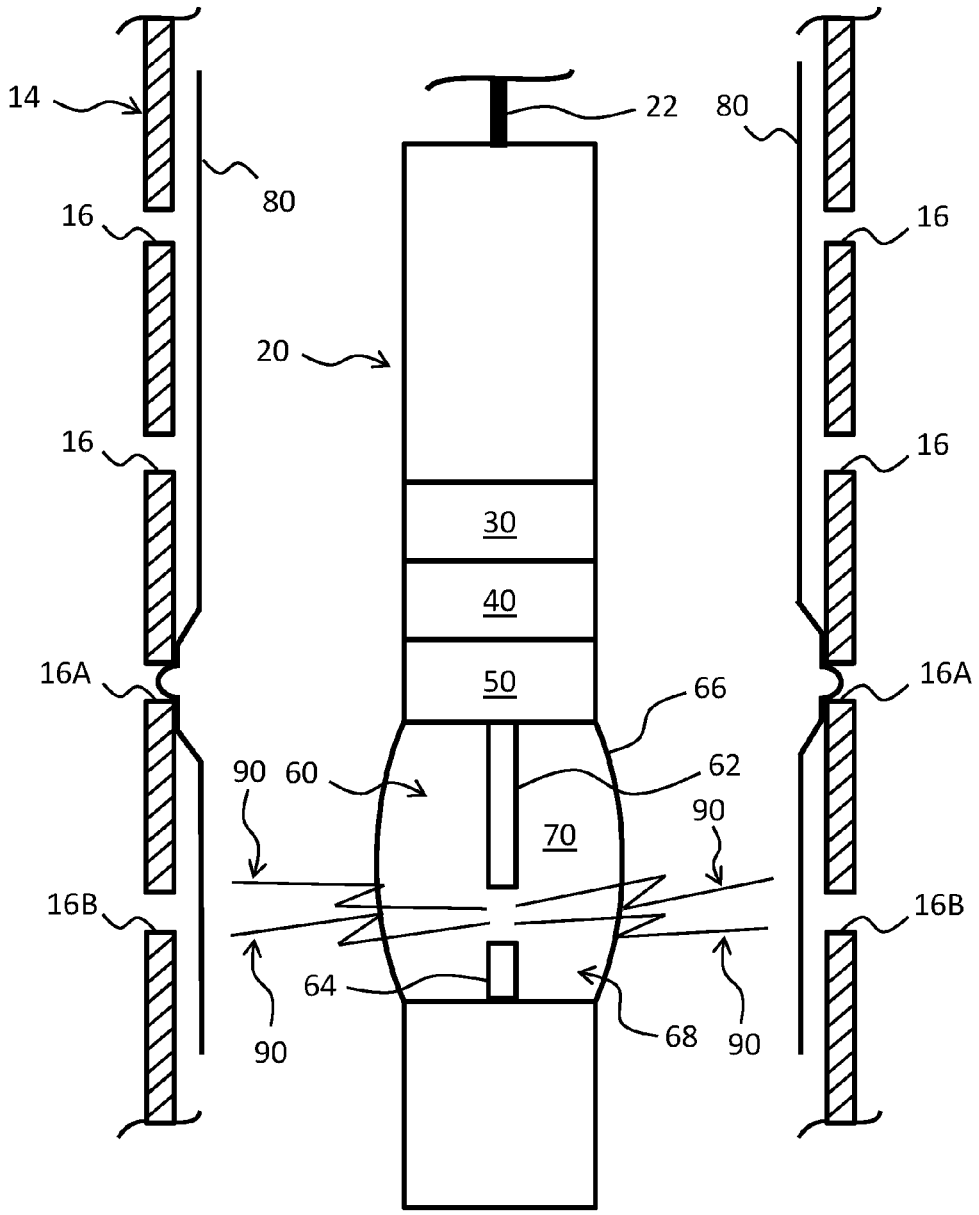
FIG. 7 illustrates shockwave generation by the shock wave generation device of FIG. 6.

The shock wave generation device 20 is then moved, in step S6, to another position inside the casing in order to seal a second plurality of perforations 16B as illustrated on FIG. 6. In this example, position of said second plurality of perforations 16B is lower than position of the first plurality of perforations 16A. This does not limit the scope of the present invention as the shock wave generation device 20 could seal the second plurality of lower perforations 16B first then be moved upwardly to seal the first plurality of higher perforations 16A.

In step S7, at least one shock wave 90, preferably a series of shock waves, is generated into the transmitting liquid 70 by the discharge unit 60 of the shock wave generation device 20. This at least one shock wave 90 propagates in step S8 through the membrane 40 toward the metal patch as illustrated on FIG. 7.

Figure 8:
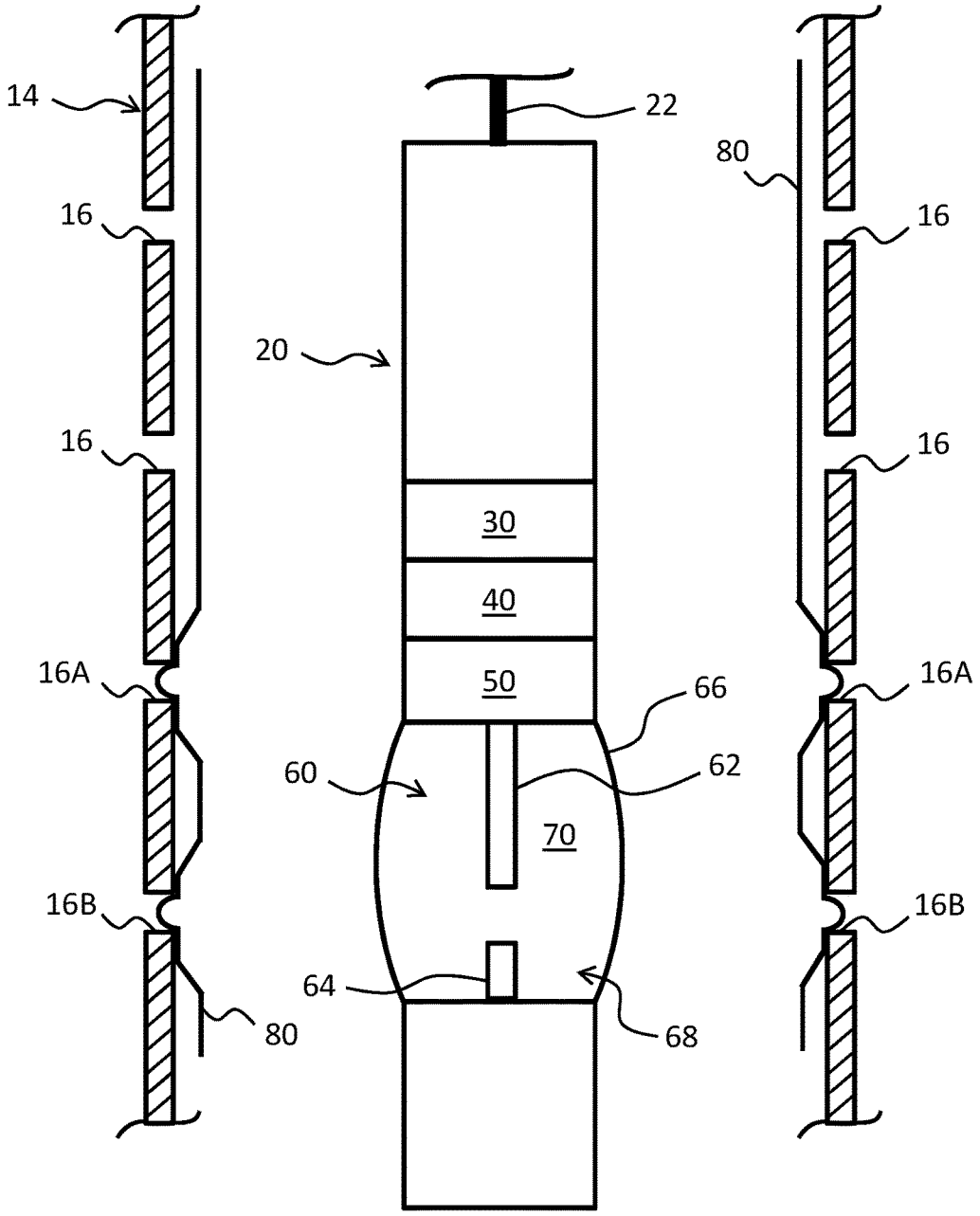
FIG. 8 illustrates sealed casing perforations following shockwave generation by the shock wave generation device of FIG. 6.
Figure 9:
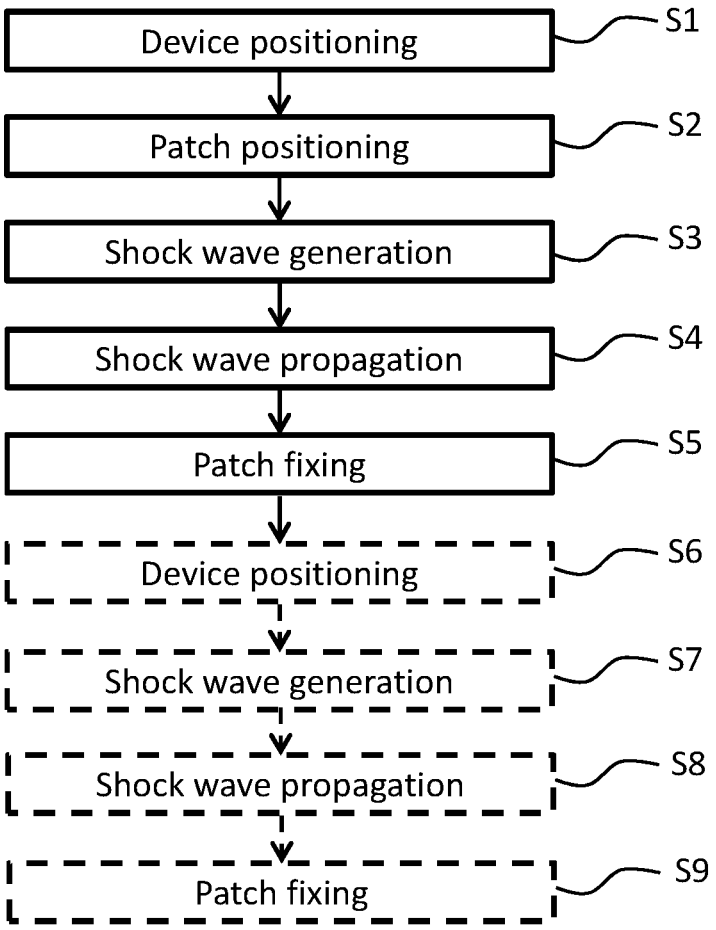
FIG. 9 illustrates an embodiment of the method according to the invention.

In step S9, the at least one propagated shock wave 90 deforms the metal patch 80 in an electrohydraulic forming process so that said metal patch 80 is compressed against the casing 14 on and into perforations 16B of the second plurality of perforations 16B, fixing the metal patch 80 to the casing 14 and sealing eventually said perforations 16B as illustrated on FIG. 8.

A series of shock waves preferably comprises at least ten shock waves, for example propagated at a periodic interval of time, e.g. every 5 to 20 seconds. A plurality of series may be advantageously repeated at different heights in wellbore 10 to seal perforations 16 located at different places on the casing therefore improving the recovery of oil or gas and the stimulation of the wellbore 10.

Supplemental Equipment

Embodiments include many additional standard components or equipment that enables and makes operable the described device, process, method and system.

Operation, control and performance of portions of or entire steps of a process or method can occur through human interaction, pre-programmed computer control and response systems, or combinations thereof.

Experiment

Examples of specific embodiments facilitate a better understanding of opening sealing method and device. In no way should the Examples limit or define the scope of the invention.

Simulations have been carried out with different metal types and different patch sizes. Aluminum-made patches seem to particularly fit the opening sealing application. In particular, 1 mm-thick circular plate patches with a diameter equal or greater than 15.6 mm reaches a maximum displacement of 1.66 mm in a standard production wellbore casing perforation, which allows efficiently sealing such perforation.

The method according to the invention is not limited to a casing and may be used to seal an opening such as a crack or a hole on various different wellbore equipment such as e.g. a sand control screen, a slotted liner, a perforated liner, a valve, a port, etc. The method according to the invention is not limited to a production wellbore and may be used into an abandoned wellbore or an injection wellbore such as a chemical or vapor injection wellbore. The invention is not limited to the described embodiment and can be applied to all type of formation fluids or gases transportation means.

What is claimed is:

1. A method for sealing at least one opening of a wellbore equipment arranged in a wellbore of a subterranean formation, the method comprising:

positioning a circular plate between the wellbore equipment and a shock wave generation device, the plate facing the at least one opening to be sealed;

generating, using the shock wave generation device, at least one electrical discharge into the wellbore in a transmitting liquid that is at least partially delimited by a membrane being made of a fluoro elastomer, said membrane having a length and a relative elongation that is at least 150% of the length when operable between the temperatures of −35° C. and 250° C., to propagate at least one shock wave through the membrane toward the plate to deform the plate and fix the plate onto the wellbore equipment to seal the at least one opening.

2. The method according to claim 1, wherein a series of at least ten shock waves is generated.

3. The method according to claim 1, wherein a plurality of series of shock waves is generated.

4. The method according to claim 3, wherein each series of shock waves is generated repeatedly at different locations along the wellbore equipment.

5. The method according to claim 3, wherein the at least one shock wave propagates radially.

6. The method according to claim 1, wherein the at least one shock wave propagates in a predetermined direction toward the plate.

7. A method of using a shock wave generation device for sealing at least one opening of a wellbore equipment arranged in a wellbore of a subterranean formation with a circular plate, the shock wave generation device comprising a chamber that is at least partially filled with a shock wave transmitting liquid and a membrane delimiting, at least partially, the chamber, the membrane being made of a fluoro elastomer and having a length and a relative elongation that is at least 150% of the length when operable between the temperatures of −35° C. and 250° C., and a discharge unit configured for generating at least one electrical discharge that propagates at least one shock wave into the transmitting liquid through the membrane towards the plate, said method comprising:

discharging at least one shock wave, said at least one shock wave adapted to deform and fix the plate onto the wellbore equipment; and sealing the at least one opening with the plate that has been deformed by the at least one shock wave.

8. A system comprising:

a shock wave generation device for sealing at least one opening of a wellbore equipment arranged in a wellbore of a subterranean formation, the shock wave generation device comprising a chamber that is at least partially filled with a shock wave transmitting liquid and a membrane delimiting, at least partially, the chamber, the membrane having a length, made of a fluoro elastomer and having a relative elongation that is at least 150% of the length when operable between the temperatures of −35° C. and 250° C.;

the wellbore equipment comprising at least one opening to be sealed arranged in the wellbore of the subterranean formation;

a circular plate arranged in the wellbore, between the shock wave generation device and the wellbore equipment, and facing the at least one opening to be sealed;

the shock wave generation device comprising a discharge unit configured for generating at least one electrical discharge that propagates at least one shock wave into the shock wave transmitting liquid through the membrane toward the plate, the at least one shock wave being adapted to deform and fix the plate onto the wellbore equipment to seal the at least one opening.

9. A system according to claim 8, the system further comprising a wireline coupled to the shock wave generation device for inserting the shock wave generation device in the wellbore nearby the wellbore equipment, a voltage source located external of the wellbore and an electrical circuit within the wireline for connecting the voltage source to the shock wave generation device.

10. The system of claim 8 wherein the discharge unit of the shock wave generation device is aligned with the at least one opening.

11. The method of claim 7 wherein the discharge unit of the shock wave generation device is aligned with the at least one opening.

12. The method of claim 1 further comprising aligning the discharge unit of the shock wave generation device with the at least one opening.

13. The system of claim 8, wherein the plate comprises aluminum.

14. The system of claim 8, wherein a diameter of the plate is greater than 15.6 mm.

15. The system of claim 8, wherein a thickness of the plate is 1 mm.

16. The method of claim 1, wherein the step of generating the electrical discharge to propagate the at least one shock wave comprises vaporizing a metallic wire placed between a first electrode and a second electrode to create a pressure wave.

17. The method of claim 1, further comprising generating the at least one electrical discharge to propagate the at least one shock wave repeatedly every 5 to 20 seconds.

18. The method of claim 1, wherein the step of positioning the plate between the wellbore equipment and the shock wave generation device comprises aligning the plate between a space between a first electrode and a second electrode of the shockwave generation device and the opening of the wellbore equipment.

* * * * *